US007547672B2

(12) United States Patent
Zaki

(10) Patent No.: US 7,547,672 B2
(45) Date of Patent: Jun. 16, 2009

(54) COMPOSITION FOR CLEANING AND DEGREASING, SYSTEM FOR USING THE COMPOSITION, AND METHODS OF FORMING AND USING THE COMPOSITION

(75) Inventor: Nael N. Zaki, Peoria, AZ (US)

(73) Assignee: Pantheon Chemical, Inc., Phoenix, AZ (US)

( * ) Notice: Subject to any disclaimer, the term of this patent is extended or adjusted under 35 U.S.C. 154(b) by 492 days.

(21) Appl. No.: 11/248,782

(22) Filed: Oct. 12, 2005

(65) Prior Publication Data

US 2006/0079423 A1 Apr. 13, 2006

Related U.S. Application Data

(60) Provisional application No. 60/617,930, filed on Oct. 12, 2004.

(51) Int. Cl.
*C11D 3/20* (2006.01)
*C11D 3/22* (2006.01)
*C11D 7/50* (2006.01)

(52) U.S. Cl. ..... 510/366; 510/413; 510/421; 510/461; 510/505; 510/506; 510/245; 510/365

(58) Field of Classification Search ..... 510/413, 510/421, 461, 505, 506, 245, 365, 366
See application file for complete search history.

(56) References Cited

U.S. PATENT DOCUMENTS

| | | | | |
|---|---|---|---|---|
| 5,194,173 | A * | 3/1993 | Folkard et al. | 134/40 |
| 5,421,907 | A | 6/1995 | Nieendick et al. | |
| 5,482,645 | A | 1/1996 | Maruyama et al. | |
| 5,585,341 | A * | 12/1996 | Van Eenam | 510/365 |
| 6,010,995 | A | 1/2000 | Van Eenam | |
| 6,372,201 | B1 * | 4/2002 | Leuridan et al. | 424/61 |
| 6,593,279 | B2 * | 7/2003 | Von Krosigk et al. | 507/267 |
| 2003/0051395 | A1 * | 3/2003 | Cox et al. | 44/444 |
| 2003/0148905 | A1 * | 8/2003 | Motson | 510/201 |
| 2003/0213747 | A1 | 11/2003 | Carbonell | |
| 2005/0197267 | A1 | 9/2005 | Zaki | |

FOREIGN PATENT DOCUMENTS

| | | | |
|---|---|---|---|
| EP | 0 498 545 | A1 | 8/2002 |
| WO | WO 92/20835 | A1 | 11/1992 |
| WO | WO 01/90291 | A1 | 11/2001 |
| WO | WO 03/072215 | A2 | 9/2003 |

OTHER PUBLICATIONS

"Castor Oil", Wikipedia, Jul. 2008, pp. 1-7.*
"Amphoteric polymers for the use in cleaning compositions", Research Disclosure, No. 483103, Jul. 2004.*
"Vegetable oil, coconut", USDA Nutrient Database for Standard Reference, Release 11, Sep. 1996.*
International Search Report and Written Opinion dated Feb. 3, 2006 in corresponding PCT case, Application No. PCT/US2005/036908.

* cited by examiner

*Primary Examiner*—Douglas Mc Ginty
(74) *Attorney, Agent, or Firm*—Snell & Wilmer L.L.P.

(57) ABSTRACT

A composition for cleaning and degreasing substrates, methods of forming and using the composition, and a system and method for recycling the composition are provided. The composition includes a 2-ethylhexyl ester and may also include co-solvents, diluents, surfactants, and adjutants.

12 Claims, 3 Drawing Sheets

COMPOSITION FOR CLEANING AND DEGREASING, SYSTEM FOR USING THE COMPOSITION, AND METHODS OF FORMING AND USING THE COMPOSITION

CROSS-REFERENCE TO RELATED APPLICATIONS

This application claims priority to and benefit of U.S. Provisional App. No. 60/617,930, entitled "Environmentally Benign Solvent Formulations For Cleaning And Degreasing And Methods For Recycling," filed Oct. 12, 2004.

TECHNICAL FIELD

The present invention relates, generally, to compositions for cleaning and degreasing substrates, and more particularly to environmentally benign cleaning compositions, including a 2-ethylehexyl ester component, to methods of forming and using the compositions, and to systems and methods of recycling the compositions.

BACKGROUND OF THE INVENTION

Solvents such as diesel fuel have long been used to clean and degrease substrates. For example, diesel fuel is often used to remove products such as crude oil and asphalt from substrates such as equipment used for the manufacture and processing of asphalt materials. Although diesel fuel works relatively well at removing the oil-based products, diesel fuel is not considered environmentally benign and its use as an asphalt cleaner is banned in some countries.

Alternative, relatively environmentally benign solvents, such as d-limonene, have been developed to replace diesel fuel as a solvent. Unfortunately, several of these alternative solvents are generally not as efficient as diesel fuel at cleaning and degreasing, they often include volatile organic compounds, and/or they have an intolerable smell. In addition, several alternative solvent compounds have relatively low flash points, making them generally unsafe to handle. Accordingly, improved compounds and methods for cleaning and degreasing are desired.

In addition, the demand for cleaning and degreasing compounds in various cleaning and manufacturing processes is substantial and generally increasing. Thus, there is also a demand for methods and systems for recycling cleaning and degreasing compositions, to thereby reduce solvent consumption.

SUMMARY OF THE INVENTION

The present invention provides a composition for cleaning and degreasing substrates, methods of forming and using the composition, and a method and system for recycling the composition. While the ways in which the present invention addresses the drawbacks of known cleaning and degreasing solutions will be described in more detail below, in general, the present invention provides an environmentally benign composition that is efficient at cleaning and degreasing.

In accordance with various embodiments of the invention, a composition for cleaning and degreasing substrates includes a 2-ethylhexyl ester. Exemplary ester moieties include benzoate, cinnamate, salicylate, and other like esters.

In accordance with one embodiment of the invention, a composition includes from about 1 to about 100 weight percent 2-ethylhexyl ester, preferably about 20 to about 99.5 weight percent, and more preferably about 30 to about 99 weight percent 2-ethylhexyl ester (e.g., 70 to about 99.5 weight percent). In accordance with various aspects of this embodiment, the composition includes a co-solvent. In this case, the co-solvent is present in an amount of about 0 to about 99 weight percent, preferably about 0 to about 40 weight percent, and more preferably about 0.5 to about 20 weight percent.

In accordance with additional embodiments of the invention, a composition includes a 2-ethylhexyl ester component and a surfactant. The surfactant can be nonionic, for example a nonionic surfactant belonging to the alcohol ethoxylate type of surfactant, or an ionic formulation. In accordance with various exemplary aspects of this embodiment, the 2-ethylhexyl ester component is present in an amount of about 0.1 to about 99 weight percent, preferably about 10 to about 99 weight percent, and more preferably about 70 to about 99 weight percent; and the surfactant is present in the amount of about 1 to about 50 weight percent, preferably about 2 to about 40 weight percent, and more preferably about 5 to about 30 weight percent (e.g., about 10 to about 30 weight percent).

In accordance with yet another embodiment of the invention, a composition includes a 2-ethylhexyl ester component, a co-solvent, a surfactant, and a diluent such as water. In accordance with this embodiment, the 2-ethylhexyl ester component is present in an amount of about 1 to about 99 weight percent, preferably about 5 to about 99 weight percent, and more preferably about 10 to about 90 weight percent; the surfactant is present in an amount of about 0 to about 60 weight percent, preferably about 1 to about 50 weight percent, and more preferably about 10 to about 40; the diluent is present in the amount of about 0 to about 50 weight percent, preferably about 0 to about 40 weight percent, and more preferably about 1 to about 30 weight percent; and the co-solvent is present in the amount of about 1 to about 20 weight percent, preferably about 1 to about 15 weight percent, and more preferably about 1 to about 10 weight percent.

In accordance with additional embodiments of the invention, a composition for cleaning and degreasing is formed by admixing a 2-ethylhexyl ester component with an additional component. In accordance with various aspects of these embodiments, the additional component is a diluent, such as water, a co-solvent, such as bio diesel, or a surfactant such as an alcohol ethoxylate type surfactant.

In accordance with yet another embodiment of the invention, a method of cleaning and degreasing includes providing a substrate and applying a composition including a 2-ethylehexyl ester to the substrate. The method may also include the step of rinsing.

In accordance with another embodiment of the invention, a system for recycling cleaning and degreasing compositions includes a chamber for receiving used cleaning and degreasing solution and pressurized gas. In accordance with various aspects of this embodiment, the system also includes a vessel for cleaning substrates and a depressurization unit. The system can be used to clean substrates and recycle the cleaning and degreasing composition, thereby reducing an amount of composition required to clean and/or degrease the substrates.

In accordance with yet another embodiment of the invention, a method of recycling a cleaning and degreasing composition includes cleaning a substrate using a cleaning a degreasing composition, exposing the spent cleaning and degreasing composition to a pressurized gas to cause waste in the spent cleaning and degreasing solution to become less soluble in the composition, removing the waste, and depressurizing the separated solution.

BRIEF DESCRIPTION OF THE DRAWINGS

The exemplary embodiments of the present invention will be described in connection with the appended drawing figures in which like numerals denote like elements and.

DETAILED DESCRIPTION

Figure 1:
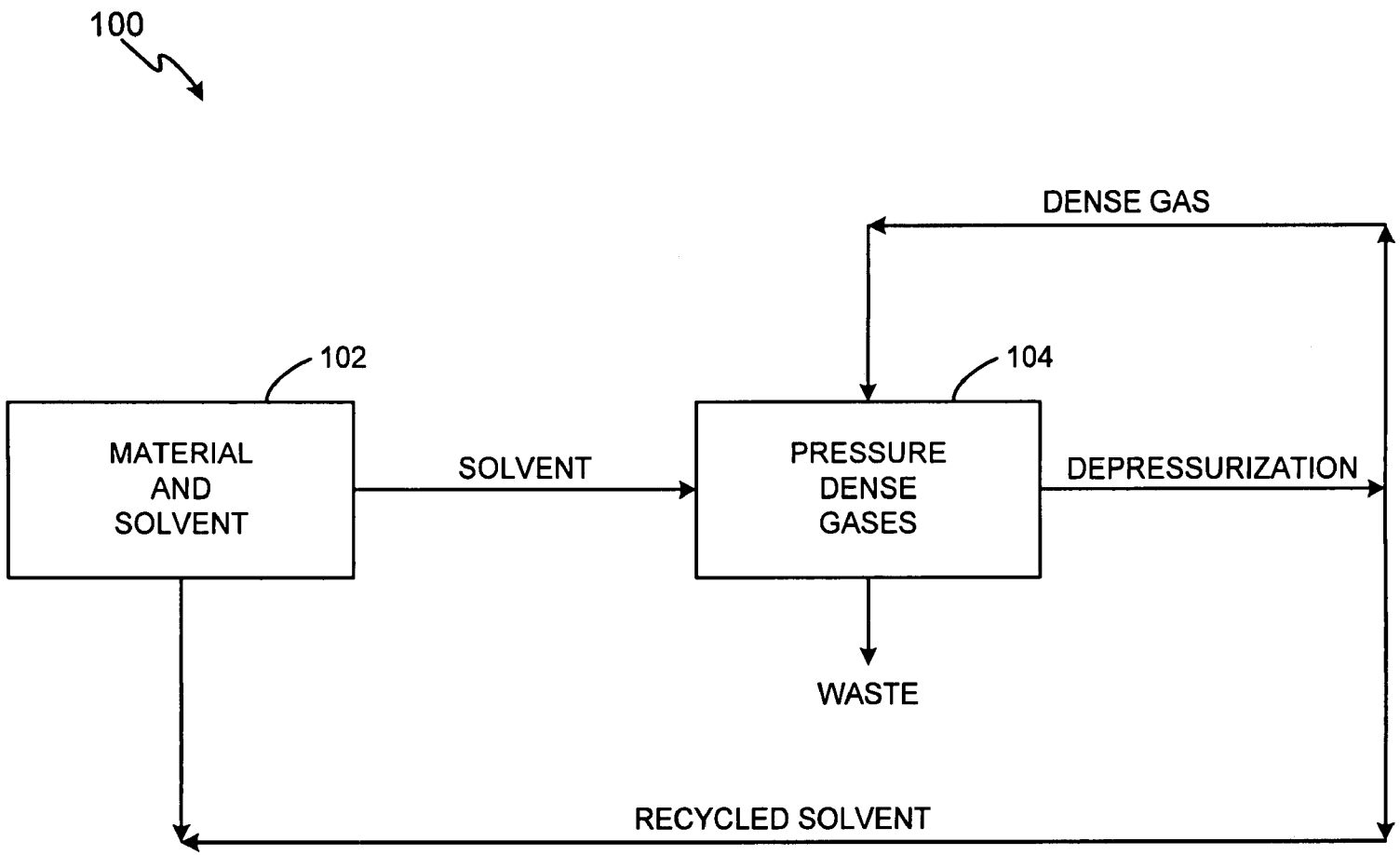
FIG. 1 illustrates a block diagram of an exemplary system for recycling a cleaning and degreasing composition in accordance with one embodiment of the invention.

The present invention provides a composition for cleaning and degreasing substrates, methods of forming and using the composition, and a system for using and recycling the composition. The composition of the present invention can be used to remove substances such as crude oil, asphalt and asphalt constitutes such as bitumen and asphaltenes, tar, sludge, grease, inks, hydraulic fluids, lubricating oils, grime, carbon deposits, and other materials from a substrate.

The composition and methods described herein may be used to clean and degrease a variety of substrates. For example, the composition can be used as a degreaser to clean equipment typically used in the manufacture or processing of asphalt, a graffiti remover, an ink remover, a gun cleaner, and an automotive parts cleaner. However, the invention is generally described below in connection with removing asphalt and asphalt constituents from equipment. Those skilled in the art will appreciate that the compositions and methods of the present invention are not limited the specific examples provided herein. For example, the compositions and methods of the present invention may be used to remove substances from other substrates, such as liquids, solids, semi-liquids, and semisolids. The substrates may be organic or inorganic materials such as sand, metal or ceramic materials.

Exemplary compositions in accordance with embodiments of the present invention are environmentally benign (i.e., non-toxic, biodegradable (about 80% in about 28 days) and have less VOC compared to other similar compositions), have a relatively high flash point, have relatively low odor, and are and relatively efficient at cleaning and degreasing.

The compositions of the present invention include a 2-ethylhexyl ester compound and may include additional constituents such as surfactants, co-solvents, and diluents as set forth in more detail below. In addition, the compositions may include optional adjuvants or inert compounds such as disinfectants—e.g., s ester quats and quaternary ammonium compounds that are non-toxic and readily biodegradable, quaternary ammonium salts of diglycol amine salts with various types of carboxylic acids, and/or salicylic acid, cinnamic acid, benzoic acid, tartaric acid, citric acid, oxalic acid, alginic acid, carboxy methyl cellulose, carboxy ethyl cellulose, and acetic acid, biodegradable food grade colorant, food grade fragrance, and the like.

Exemplary 2-ethylhexyl ester compounds suitable for use with compositions of the present invention include 2-ethylhexylbenzoate, 2-ethylhexylcinnamate, 2-ethylhexylsalicylate, 2-ethylhexyloleate, 2-ethylhexylpalmitate, 2-ethylhexyladipate, 2-ethylhexylstearate, 2-ethylhexylsuccinate, and other like 2-ethylhexyl ester compounds.

In accordance with one exemplary embodiment of the invention, a composition for cleaning and degreasing includes one or more 2-ethylhexyl ester components and may additionally include a co-solvent. This composition is particularly useful for removing asphalt and sealants from substrates. In accordance with various aspects of this embodiment, the composition includes a co-solvent such as bio diesel, propylene glycol monomethyl ether, dipropylene glycol monomethyl ether, tripropylene glycol monomethyl ether, dipropylene glycol n-propyl ether, tripropylene glycol n-propyl ether, propylene glycol n-butyl ether, dipropylene glycol n-butyl ether, tripropylene glycol n-butyl ether, and dipropylene glycol dimethyl ether; fatty acids methyl esters such as methyl stearate ester, methyl oleate ester, methyl palmitate ester, methyl soyate ester, methyl linoleate ester, and methyl linoleneate ester; fatty acid amides with diglycolamine; fatty acids amine salts with diglycolamine; and the like. However, in accordance with an alternative embodiment, the composition includes substantially 100 percent 2-ethylhexyl ester. In accordance with various aspects of the embodiment, the composition includes about 1 to about 100 weight percent, preferably about 80 to about 100 weight percent, and more preferably about 95 to about 100 weight percent 2-ethylhexyl ester—for example, about 98 to about 99.5 weight percent; and about 0 to about 99 weight percent, preferably about 0 to about 20 weight percent, and more preferably about 0.5 to about 2 weight percent of a co-solvent such as bio diesel.

In accordance with another embodiment of the invention, a composition includes a 2-ethylhexyl ester component and a surfactant. The surfactant increases the rinseability of the composition, which may be desirable when the composition is used to clean substrates such as asphalt processing equipment. In particular, it may be desirable to rinse the composition from asphalt or other processing equipment, because the cleaning composition may have deleterious effects—e.g., stripping of bitumen of asphalt—on materials placed in the equipment after cleaning.

Surfactants suitable for use with compositions of the present invention include nonionic and ionic surfactants. Exemplary nonionic surfactants include alcohol ethoxylate type of surfactants, having an alcohol carbon chain length ranging from $C_1$ to $C_{24}$ and preferably from $C_6$ to $C_{18}$; and more preferably from $C_9$ to $C_{11}$ alcohol ethoxylated with from 1 to 28 units of ethylene oxide molecules and preferably from 1 to 10 ethylene oxide molecules, and more preferably from 1 to 6 ethylene oxide molecules. Other examples of surfactants are ethoxylated sugar alcohols, such as sorbitol and manitol, and the like. Exemplary ionic surfactants include alcohol sulfates, alcohol sulfonates, sulfosuccinates, sulfated fatty acids, and the like.

In accordance with various aspects of this embodiment, the 2-ethylhexyl ester component is present in an amount of about 0.1 to about 100 weight percent, preferably about 10 to about 100 weight percent, and more preferably about 70 to about 100 weight percent; and the surfactant is present in the amount of about 1 to about 40 weight percent, preferably about 1 to about 30 weight percent, and more preferably about 1 to about 25 weight percent.

In accordance with yet another embodiment of the invention, a composition includes a 2-ethylhexyl ester component, a surfactant, a co-solvent, and a diluent. Suitable diluents for use with compositions of the present invention include water.

In accordance with this embodiment, the 2-ethylhexyl ester component is present in an amount of about 1 to about 99 weight percent, preferably about 5 to about 99 weight percent, and more preferably about 10 to about 99 weight percent; the diluent is present in the amount of about 0 to about 50 weight percent, preferably about 0 to about 40 weight percent, and more preferably about 1 to about 30 weight percent; the surfactant is present in the amount of about 0 to about 60 weight percent, preferably about 1 to about 50 weight percent, and more preferably about 10 to about 40 weight percent; and the co-solvent is present in the amount of about 1 to about 20 weight percent, preferably about 1 to about 15 weight percent, and more preferably about 1 to about 10 weight percent.

In accordance with another embodiment of the invention, a method of cleaning a substrate includes applying a composition including a 2-ethylhexyl ester to a substrate. In accordance with various additional aspects of this embodiment, the method includes applying a composition including a 2-ethylhexyl ester and a co-solvent, a 2-ethylhexyl ester and a surfactant, a 2-ethylhexyl ester and a diluent, and various combinations thereof. Methods of cleaning may also further include rinsing the substrate with, for example, water.

The following non-limiting examples illustrate specific exemplary compositions in accordance with various embodiments of the invention. These examples are merely illustrative, and it is not intended that the invention be limited to these examples. Compositions in accordance with the present invention may include the ingredients listed below as well as additional and/or alternative inert materials, surfactants, and other constituents typically found in compositions for cleaning or degreasing.

EXAMPLE 1

An exemplary composition was formed by admixing about 99 wt % 2-ethylhexyl benzoate and about 1% methyl soyate. The asphalt removal efficiency of this formulation is about 50% better than diesel fuel.

EXAMPLE 2

Another exemplary composition was formed by admixing about 80 wt % 2-ethylhexyl benzoate and about 20 wt % alcohol ethoxylate surfactant $C_9$-$C_{11}$ alcohol ethoxylated with 4 ethylene oxide units. The asphalt removal efficiency of this formulation is about 50% better than diesel fuel and it is rinsable with water.

EXAMPLE 3

Yet another exemplary composition was formed by admixing about 33.33 wt % 2-ethylhexyl benzoate, about 11.10 wt % dipropylene glycol monomethyl ether, about 55.56 wt % alcohol ethoxylate surfactant $C_9$-$C_{11}$ alcohol ethoxylated with 4 ethylene oxide units. This formulation can form a microemulsion with water which can be added up to 60% water and still be effective in degreasing surfaces from oils and greases.

In accordance with additional embodiments of the present invention, a method and system for recycling a used cleaning composition includes the use of dense gases create an anti-solvent effect. The used solvent is recycled through the use of supercritical fluids/compressed gases which impart a new solubility parameter value for the solvents, for example to expand the used solvent, thus decreasing the ability for the solvents to hold the solute wastes, such as dissolved greases, bitumen, and the like, and leaving the wastes insoluble. The compressed gas/solvent mixture can then be decompressed, resulting in gas separation from the solvent and allowing for recycling of the gas and solvents.

FIG. 1 illustrates a system 100 for recycling cleaning compositions in accordance with various embodiments of the invention. System 100 includes a first vessel 102 for cleaning materials, parts and components, such as fabrics, machinery, metal parts and the like and a second vessel 104 for pressurization of the used solvent and wastes with dense gases. Although illustrated with a first vessel 102, systems in accordance with other embodiments of the invention do not require a cleaning vessel. In such cases, the cleaning composition is pumped or placed directly in pressurized vessel 104.

First vessel 102 can comprise any conventional vessel used for cleaning of materials, parts or components. Exemplary vessels suitable for first vessel 102 include a closed stainless steel vessel for use with fabrics.

Vessel 104 can comprise any pressurized vessel or chamber configuration capable of pressures ranging from approximately 100-3000 psi or more, and operating at a temperature ranging from approximately 10-70 degrees Celsius. For example, vessel 104 may be a countercurrent separation column suitable for operating at these pressures and temperatures.

In operation, system 100, parts are cleaned in vessel 102 and the used cleaner and waste is transferred to vessel 104. Dense gas or a dense gas mixture is then introduced to vessel 104 to a pressure of about 100-3000 psi at a temperature of about 10-70 degrees Celsius. Exemplary dense gases suitable for use with this embodiment include methane, ethane, propane, butane, carbon dioxide, ammonia, or mixtures of these components. The dense gases can also contain traces of alcohols such as ethanol, methanol, iso-propanol, n-propanol, iso-butanol, and n-butanol.

After separation of the waste from the solvent/gas mixture, the solvent can be separated from the dense gas or dense gas mixtures through depressurization, which may be performed in vessel 104. This allows the dense gases to be recycled back to vessel 104 and the cleaning solution to be recycled back for use again in cleaning vessel 102.

System 100 allows for substantially all of the dense gases and solvents to be recovered. For example, depending on the chemical nature of the dense gases and solvents, approximately 97% or more of the gases and solvents can be recycled, with the purity of the solvent reaching about 99.99% of its original state in many applications.

Figure 2:
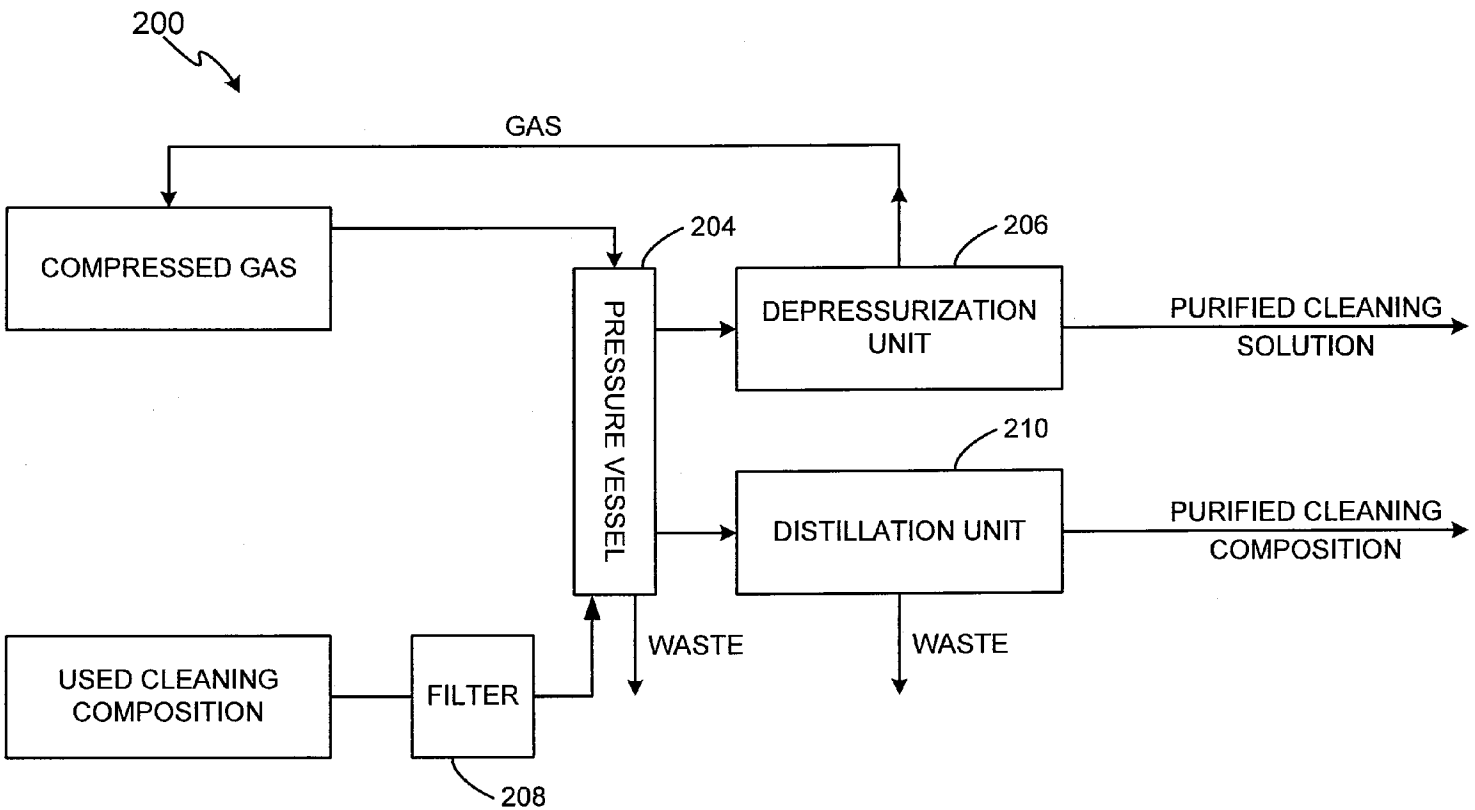
FIG. 2 illustrates a block diagram of another exemplary system for recycling a cleaning and degreasing composition in accordance with another embodiment of the invention.

FIG. 2 illustrates another system 200 for recycling cleaning solutions in accordance with various embodiments of the invention. System 200 includes a vessel 204 for subjecting the used cleaning composition to compressed gas, a depressurization unit 206, and optionally includes a filter 208 and a separator 210. Vessel 204 may be the same as vessel 104 described above in connection with system 100. Optional depressurization unit 206 may include any vessel suitable for reducing the pressure of the gas/cleaning composition mixture. Optional filter 208 may include any desired filter compatible with the compositions of the present invention. The separator 210 may include, for example, a spinning band distillation column to further separate the waste from the cleaning solution.

System 200 operates in generally the same manner as system 100. Used cleaning composition with waste is fed to a vessel 204. The composition may be fed directly into vessel 204 or the solution may be filtered using filter 208. Pressurized gas is then fed into vessel 204, which decreases the solubility of waste in the cleaning solution. Waste is removed from the solution at this point. The cleaning solution/gas mixture is then fed to depressurization unit 206 to separately recover the gas and the cleaning solution. Some of the cleaning solution/waste mixture may also be fed to unit 210 to further separate any waste remaining in the cleaning solution.

Figure 3:
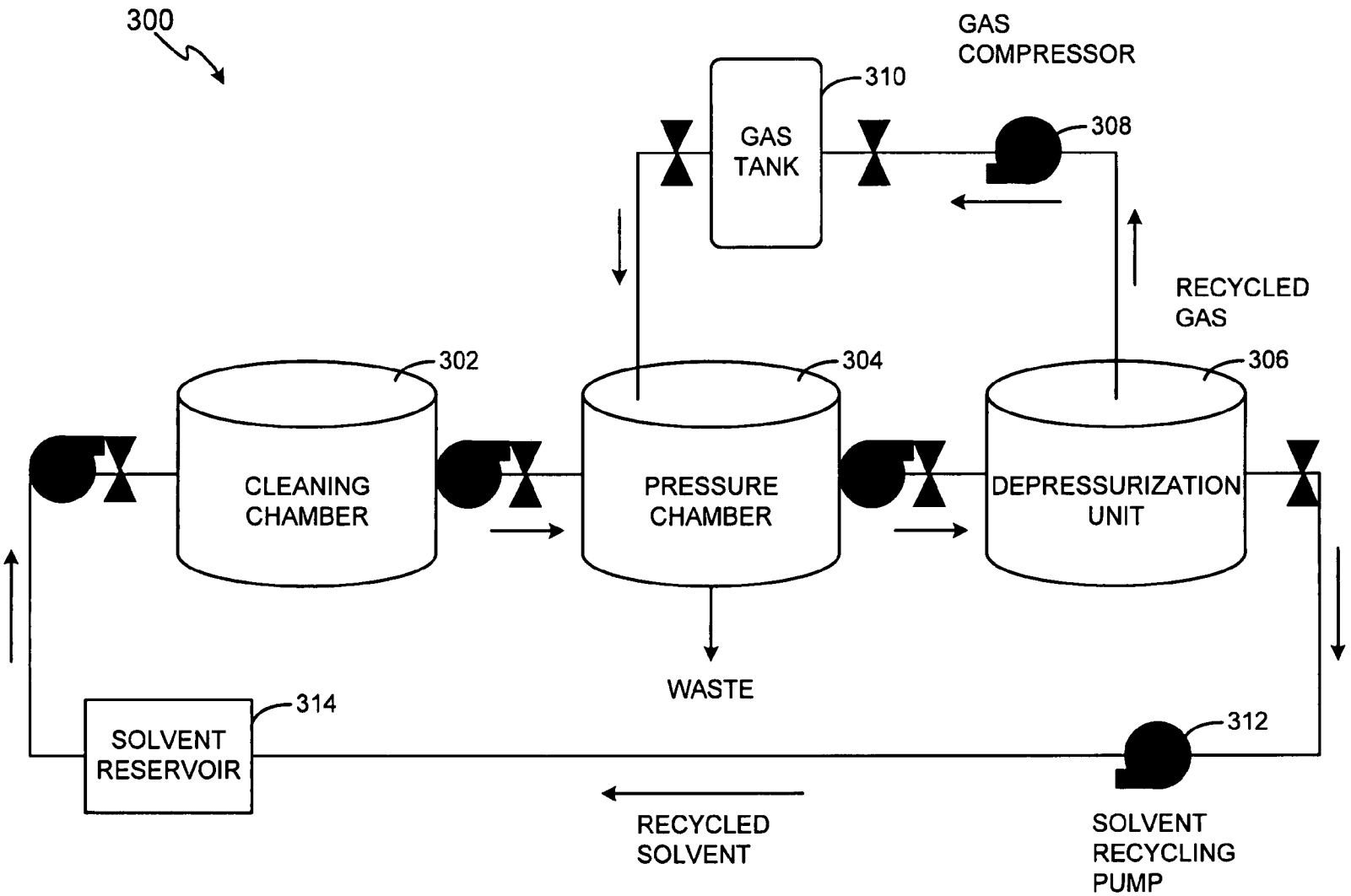
FIG. 3 illustrates a block diagram of yet another exemplary system for recycling a cleaning and degreasing composition in accordance with a further embodiment of the invention.

FIG. 3 illustrates yet another exemplary recycling system 300, which includes a first cleaning chamber 302, a pressure chamber 304, a depressurization unit 306, a gas compressor 308, a gas tank 310, a solvent recycling pump 312 and a solvent reservoir 314. System 300 may also comprise various other fluid pumps and control valves configured to perform functions that facilitate recycling.

During operation, the material/object to be cleaned is mixed with the solvent in the cleaning chamber 302 that optionally provides agitation and mixing. After the washing cycle is finished, the cleaning solution plus the wastes that are removed from the material are pumped to pressure chamber 304, where dense gas or gas mixtures are compressed into chamber 304 and mixed with the solvent containing the wastes. The compressed gas dissolves in the cleaning solution leaving the wastes insoluble therein. The wastes can then be removed (e.g., for disposal, incineration, or purification), and the dense gas/cleaning solution mixture is then sent to depressurization chamber 306. In depressurizing chamber 306, the pressure is gradually released, which results in the gas separating from the solvent. The dense gas and mixtures can then be recompressed in gas compressor 308 and returned to gas tank 310 for recycled usage. Similarly, the cleaning composition can be pumped through solvent recycling pump 312 back to solvent reservoir for storage and further use.

The present invention sets forth cleaning compositions that are relatively non-toxic, biodegradable, non-corrosive to most metals, non-explosive, non-flammable, and have minimal or no VOC and HPA and methods of using and recycling the compositions. It will be understood that the foregoing description is of exemplary embodiments of the invention, and that the invention is not limited to the specific illustrative compositions, methods, and systems. Various modifications may be made in the actual compositions and methods set forth herein without departing from the scope of the invention. These and other changes or modifications are intended to be included within the scope of the present invention.

I claim:

1. A composition for cleaning and recycling comprising:

about 0 to about 50 weight percent diluent;

about 1 to 50 weight percent surfactant;

about 0.5 to about 20 weight percent co-solvent, wherein the co-solvent is selected from a group consisting of propylene glycol monomethyl ether, dipropylene glycol monomethyl ether, tripropylene glycol monomethyl ether, dipropylene glycol n-propyl ether, tripropylene glycol n-propvl ether, dipropylene glycol n-butyl ether, propylene glycol n-butyl ether, tripropylene glycol n-butyl ether, dipropylene glycol dimethyl ether, fatty acid methyl esters, and fatty acid amides; and about 10 to about 99.5 weight percent 2-ethylhexyl ester, wherein the 2-ethylhexyl ester is selected from the group consisting of 2-ethylhexylcinnamate, of 2-ethylhexylsalicylate, 2-ethyihexyladipate, 2-ethylhexylstearate, and 2-ethyihexylsuccinate.

2. The composition of claim 1, wherein the co-solvent is a fatty acid methyl ester selected from the group consisting of methyl stearate ester, methyl oleate ester, methyl palmitate ester, methyl soyate ester, methyl linoleate ester, and methyl linoleneate ester.

3. The composition of claim 1, wherein the surfactant is a nonionic surfactant.

4. The composition of claim 3, wherein the nonionic surfactant is an alcohol ethoxylate.

5. The composition of claim 4, wherein the alcohol ethoxylate carbon chain length ranges from $C_1$-$C_{24}$.

6. The composition of claim 4, wherein the alcohol ethoxylate carbon chain length ranges from $C_6$ to $C_{18}$ and it has from 1 to 10 ethylene oxide units.

7. The composition of claim 3, wherein the nonionic surfactant is a an ethoxylated sugar alcohol.

8. The composition of claim 7, wherein the ethoxylated sugar alcohol is selected from the group consisting of sorbitol and mannitol.

9. The composition of claim 1, wherein the diluent is present.

10. The composition of claim 9, wherein the diluent is water.

11. A composition for cleaning and recycling according to claim 1 having:

about 0.5 to about 2 weight percent co-solvent; and about 70 to about 99.5 weight percent 2-ethylhexyl ester, wherein the 2-ethylhexyl ester is selected from the group consisting of 2-ethylhexylcinnamate, of 2-ethylhexylsalicylate, 2-ethylhexyladipate, 2-ethylhexylstearate, and 2-ethylhexylsuccinate.

12. A composition for cleaning and recycling according to claim 1 having:

about 5 to about 30 weight percent surfactant; and about 70 to about 90 weight percent 2-ethylhexyl ester, wherein the 2-2ethylhexyl ester is selected from the group consisting of 2-ethylhexylcinnamate, of 2-ethylhexylsalicylate, 2-ethylhexyladipate, 2-ethylhexylstearate, and 2-ethylhexylsuccinate.

* * * * *